United States Patent [19]

Cavalli

[11] Patent Number: 4,586,278

[45] Date of Patent: May 6, 1986

[54] STEAM IRON WITH AN EXCESS PRESSURE SAFETY DEVICE

[76] Inventor: Alfredo Cavalli, via Galileo Galilei, 9, Pesano Con Bornago (Milan), Italy

[21] Appl. No.: 698,806

[22] Filed: Feb. 6, 1985

[51] Int. Cl.[4] ..... D06F 75/18
[52] U.S. Cl. ..... 38/77.81
[58] Field of Search ..... 38/77.81, 77.8, 77.9, 38/88, 77.82

[56] References Cited

U.S. PATENT DOCUMENTS

| | | | |
|---|---|---|---|
| 2,357,862 | 9/1944 | Wolcott et al. | 38/77.81 |
| 2,682,719 | 7/1954 | Cone | 38/77.81 X |
| 3,041,757 | 7/1962 | Swenson et al. | 38/77.81 X |
| 3,156,054 | 11/1964 | Davidson | 38/77.82 |
| 4,296,560 | 10/1981 | Schwob | 38/77.81 |

FOREIGN PATENT DOCUMENTS 2924300 6/1979 Fed. Rep. of Germany ..... 38/77.8

*Primary Examiner*—Werner H. Schroeder
*Assistant Examiner*—Andrew M. Falik
*Attorney, Agent, or Firm*—Cohen, Pontani & Lieberman

[57] ABSTRACT

An iron in which an evaporation chamber formed in the body of the iron is in liquid communication with a water supply duct through a passage formed in the body of the iron. This passage and the supply duct are interconnected by means of a sleeve the portion whereof which is sealingly fitted onto the water supply duct is resiliently yieldable. When the pressure in the sleeve reaches a predetermined value the deformation of the resiliently yieldable portion allows rapid and effective venting of the steam until the excess pressure is relieved. The resiliently yieldable portion constitutes a safety device against excess steam pressures accidentally generated in the evaporation chamber.

2 Claims, 1 Drawing Figure

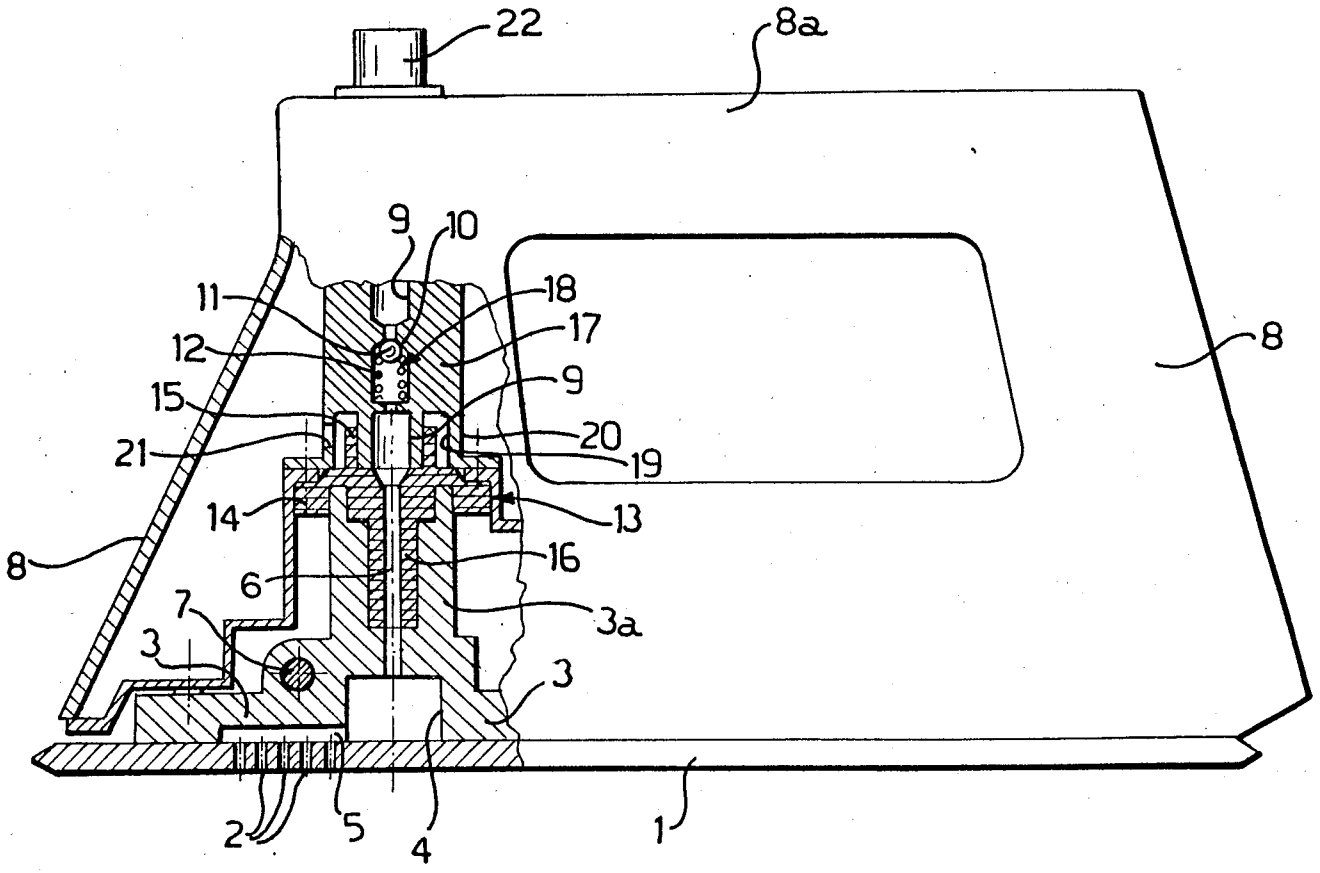
8
8a
22
10
9
18
17
9
20
19
13
16
3a
3
1
4
5
2
11
12
15
21
14
6
7
3
8

STEAM IRON WITH AN EXCESS PRESSURE SAFETY DEVICE

BACKGROUND OF THE INVENTION

The present invention relates to a steam iron with a safety device for the relief of internal excess pressures generated in the evaporation chamber thereof.

The ease with which calcarious deposits and encrustations form within a steam iron is well known. Numerous systems have been tried to prevent such a formation or at least to limit it to zones which are readily accessible from the outside of the iron and not dangerous with regard to its operation.

But however much it is slowed down, the inevitable formation of calcarious deposits causes the risk of more or less considerable obstructions in the steam ducts communicating with the evaporation chamber until the normal steam flow is quite blocked.

In such a case, an excess pressure is generated in the evaporation chamber and this is a recognized cause of damage of different types and degrees both to the iron and to the user, for example due to an unforeseen jet of pressurized steam at relatively high temperatures ejected from an unforeseeable part of the casing with which an iron is normally provided.

The main object of the present invention is to provide a steam iron of the type under consideration in which any excess pressure generated in the evaporation chamber causes neither damage to the iron nor danger to the user.

SUMMARY OF THE INVENTION

This object is achieved according to the present invention by a steam irom comprising a body, an evaporation chamber formed in the body, and a water supply duct in liquid communication with the evaporation chamber through a passage formed in the iron body, wherein the iron further includes a sleeve having a first portion at one end sealingly connected to the passage and a second portion at the other end sealingly fitted to the supply duct, the second sleeve portion being resiliently yieldable when a predetermined pressure is reached within the sleeve to vent the evaporation chamber of said body.

When an excess pressure is generated in the evaporation chamber and hence is present in the sleeve, it causes the resiliently yieldable portion thereof to yield resiliently, with a consequent reduction in the degree of sealing between the resiliently yieldable portion and the water supply duct to which the portion is fitted. The steam is thus automatically vented to the exterior of the body of the iron.

This is not dangerous with regard to the operation of the iron since the resilience of the sleeve portion in question causes the automatic renewal of the sealing after the venting of the steam. There is no risk to the operator since the steam venting occurs in a predetermined position on the iron body within the casing which normally covers the body.

DETAILED DESCRIPTION OF THE DRAWINGS

The characteristics and advantages of the invention will become more apparent from the description which follows of a preferred embodiment of a steam iron, made with reference to the single appended drawing which is a partially-sectioned side view of a steam iron according to the invention.

With reference to the said drawing, a steam iron comprises an ironing plate 1 having a plurality of steam delivery apertures 2 fixed by conventional means, not shown, to an iron body 3 enclosed in a protective casing 8 of conventional form defining a handgrip 8*a* for the use of the iron.

Within the body 3 of the iron there is formed an evaporation chamber 4 in fluid communication with the apertures 2 in the plate 1 through at least one duct 5.

Over the evaporation chamber 4, the body 3 of the iron is provided with an upstanding portion 3*a* called a tower in the following description. The tower 3*a* has an axial through passage 6 for conducting liquid to the evaporation chamber 4 from a water supply duct 9. The duct 9 in turn communicates with a water reservoir, not illustrated since it is entirely conventional, which may be mounted on the iron or be structurally separate therefrom.

A non-return valve 18 is located in the duct 9 and includes a valve seat 10 formed in the duct 9, a ball shutter 11 and a return spring 12 which urges the shutter 11 to close the valve seat 10.

The supply duct 9 and the passage 6 for leading the water to the evaporation chamber 4 are connected by a sleeve 13 formed of heat resistant, resiliently yieldable material, preferably a silicone rubber. The sleeve 13 has a substantially stopper-like portion 14 fitted onto the tower 3*a* with a pressurized fluid-tight seal and a cup-shaped portion 15 fitted onto the duct 9 with a predetermined degree of forcing so as to achieve a resilient preloading which ensures a pressurized fluid-tight seal until a predetermined pressure is reached within the sleeve in question.

To advantage the sleeve 13 includes an axial extension 16 which constitutes an internal lining of at least a portion of said passage 6 for conducting liquid to the evaporation chamber 4.

In accordance with one characteristic of this invention, the duct 9 is formed axially in a block 17 supported above the tower 3*a* in a position which is fixed so as to exert a desired pressure on the stopper portion 14 of the sleeve 13.

An annular recess 19 is formed coaxially in an end portion of the block 17 facing the tower 3*a*. The annular recess 19, which surrounds a tubular projection on which the cup-shaped portion 15 of the sleeve 13 is fitted, has a radial width greater than the thickness of the portion 15 so as not to obstruct the elastic deformations which the cup portion 15 undergoes should there be an excess pressure in the sleeve, as will become clearer from the description below. The outer wall of the annular recess 19 is defined by a skirt 20 in which vent passages 21 are formed.

OPERATION

During the normal operation of the steam iron, the sleeve 13 behaves as a sealing washer between the water supply duct 9 and the passage 6 communicating with the evaporation chamber 4. The water withdrawn from the water reservoir (not shown) for example by a pump, also not shown since it is entirely conventional, operated by a push button 22 accessible on the handgrip 8*a* of the iron, is supplied at a certain pressure to the evaporation chamber 4 by opening of the valve 18 against the action of the return spring 12. When the water reaches the chamber 4 it is heated by an electrical resistance 7 with which the body 3 of the iron is provided conventionally and is immediately vaporized, the steam thus generated being discharged through the apertures 2 in the ironing plate 1.

If for any reason, in particular due to the formation of calcarious deposits, the free flow of the steam generated is obstructed or absolutely prevented, the steam is trapped in the chamber 4 since the valve 18 does not allow it to flow back to the reservoir. When the consequent pressure increase of the steam thus trapped reaches a predetermined value, the cup portion 15 of the sleeve 13 yields resiliently, widening around the duct 9 so as to reduce the degree of sealing therewith. Consequently the steam may be discharged first into the annular recess 19 and then through the vent passages 21 into the casing 8. When the steam pressure in the chamber 4 falls below the predetermined value, the cup portion 15 of the sleeve 13 resumes resiliently its position on the duct 9, renewing the desired sealing. Naturally, if the obstruction to the normal flow of steam is not removed, the venting cycle described above will continue to repeat itself.

The cup portion 15 of the sleeve 13 essentially constitutes a safety device against accidental excess pressures generated in the evaporation chamber 4.

I claim:

1. A steam iron having a safety device for relief of excess internal pressure, the iron comprising:

a body, means defining an evaporation chamber in said body, a water supply duct, a passage in said body providing liquid communication between said supply duct and said evaporation chamber, and a sleeve having a first end portion sealingly connected to said passage and a second end portion sealingly fitted onto the supply duct, said second portion being resiliently yieldable in response to a predetermined pressure within the sleeve to vent the evaporation chamber of the said body.

2. Steam iron as defined in claim 1, wherein the sleeve is formed from silicone rubber and includes an axial extension which constitutes an inner lining of at least a portion of said passage formed in said body.

* * * * *